United States Patent [19]

Hager

[11] 4,287,239

[45] Sep. 1, 1981

[54] METHOD FOR WOOD PRESERVATION

[76] Inventor: Bror O. Hager, Forsetevagen 5, S-182 63 Djursholm, Sweden

[21] Appl. No.: 132,890

[22] Filed: Mar. 24, 1980

Related U.S. Application Data

[63] Continuation-in-part of Ser. No. 4,449, Jan. 18, 1979, abandoned.

[30] Foreign Application Priority Data

Jan. 27, 1978 [SE] Sweden ..... 7801013

[51] Int. Cl.[3] ..... B05D 3/02; B05D 3/12; B05D 1/18

[52] U.S. Cl. ..... 427/351; 427/372.2; 427/397; 427/440

[58] Field of Search ..... 427/440, 297, 351, 397, 427/372.2

[56] References Cited

U.S. PATENT DOCUMENTS

| | | | |
|---|---|---|---|
| 1,984,254 | 12/1934 | Curtin et al. | 427/440 |
| 2,149,284 | 3/1939 | Gordon | 427/440 |
| 3,560,251 | 2/1971 | Hager | 427/440 |
| 3,945,835 | 3/1976 | Clarke et al. | 427/440 X |
| 3,957,494 | 5/1976 | Oberley | 427/440 X |

FOREIGN PATENT DOCUMENTS

| | | | |
|---|---|---|---|
| 36336 | of 0000 | Finland | 427/440 |
| 92274 | of 0000 | Norway | 427/440 |
| 100544 | of 0000 | Norway | 427/440 |
| 39003 | of 0000 | Sweden | 427/440 |
| 182404 | of 0000 | Sweden | 427/440 |
| 182477 | of 0000 | Sweden | 427/440 |
| 202417 | of 0000 | Sweden | 427/440 |
| 371772 | of 0000 | Sweden | 427/440 |
| 396312 | of 0000 | Sweden | 427/440 |

*Primary Examiner*—Michael R. Lusignan
*Attorney, Agent, or Firm*—Burns, Doane, Swecker & Mathis

[57] ABSTRACT

An improved method for the preservation of hardwood by treatment thereof with a preservation solution is disclosed. The wood is treated with a preservative solution which is not readily fixed and is then kept in an undried condition for a period of time sufficient to allow the preservative solution to penetrate the wood and diffuse through the cell walls of the wood without fixation thereof. The wood is then dried so as to fix the preservative. Enhanced periods of preservation effectiveness are thus obtained.

18 Claims, No Drawings

METHOD FOR WOOD PRESERVATION

CROSS-REFERENCE TO RELATED APPLICATIONS

This application is a continuation-in-part of application Ser. No. 4,449, filed on Jan. 18, 1979, now abandoned.

BACKGROUND OF THE INVENTION

Foliiferous wood (i.e., hardwood) is generally easy to impregnate. Solutions containing preservatives can be rapidly forced by means of pressure into the wood. As a rule the entire mass of the foliiferous wood is penetrated by the preservative solution, in contrast to pine wherein only the sap wood is penetrated. It had been earlier thought that this caused few problems since good results had been obtained by the pressure treatment of sleepers of beech with creosote oil.

This opinion has recently been modified. It is clear that foliiferous wood treated with salt-containing preservative solutions provides prolonged periods of use but the preservation treatment has been much less effective than expected. Since the salts are well fixed in the wood, the lessened effect of the treatment has not been considered to depend on the leaching effect of the preservative. The preserving salt has, in all probability, been effective against the wood destroying organisms which appear in and destroy foliiferous wood. The long-term ineffectiveness of the treatment has been observed in several different types of preservatives of different origin. An explanation for the observed long-term ineffectiveness of the preservatives is believed to have been found by electron microscopic studies of the wood. It appears from these studies that the preservatives have not penetrated the cell walls of the wood. The inner part of the cell walls have thus remained untreated. The wood destroying organisms have thus been able to grow within the inner part of the cell walls and destroy the wood.

SUMMARY OF THE INVENTION

The present invention discloses an improved method of satisfactorily preserving foliiferous wood. The method is based upon the use of specific types of preservatives in combination with specific methods and conditions of penetration and distribution of these preservatives within the wood.

The preservatives used according to the present invention must be such that they remain in dissolved form (i.e., in an unfixed state) in the wood for a certain period of time after the preservation treatment by keeping the wood in an undried condition. Only then are they allowed to become "fixed" within the wood by permitting the wood to dry. It is thus possible to ensure that these preservatives pass through the cell walls. The preservation methods of this invention provide for the introduction of the preservative into the wood with the wood thereafter being kept in an undried condition for a period of time during which no fixation of the preservative occurs. During this time the preservative diffuses through the cell walls. Thereafter the conditions for the storing of the wood are changed (i.e., the wood is dried) so that the preservative becomes fixed within the wood. The foliiferous wood is thus rendered more resistant to wood-destroying organisms.

DETAILED DESCRIPTION OF THE INVENTION

Conventional water soluble preservatives are not suitable for use in the method of the present invention due to their tendency to become fixed in the wood prematurely. For example, such well known preservatives now in use are described in U.S. Pat. No. 2,565,175 (containing copper, chromium and arsenic compounds) which is a development of the preservative disclosed in U.S. Pat. Nos. 2,139,747; 2,149,284 (based upon copper compounds and arsenic trioxide dissolved in ammonia); 1,984,256 (containing zinc compounds and arsenic trioxide dissolved in acetic acid); and 2,749,256 (containing copper formate), the disclosures of which are herein incorporated by reference.

These preservatives all contain either copper or zinc as an active cation and arsenic as an active anion. The copper or zinc together with the arsenic compounds provide good protection against wood destroyers, with the arsenic being of special value for protection against termites, which usually are present in the areas where the treatment of foliiferous wood is of particular interest.

These specific preservatives exhibit different properties. However, in order to adapt them to the preservation method of the present invention, their properties must be modified to prevent them from becoming fixed in the wood prematurely, especially since hardwoods seem to need more preservative components (e.g., copper) than softwoods to provide suitable protection against soft rot.

The first described preservative generally consists of copper oxide, chromic acid and arsenic acid (arsenic pentoxide). The presence of the acid ingredients, i.e., the chromic acid and to a certain extent the arsenic acid, ensures that the preservatives can be kept in solution. When the solution is introduced into the wood the chromium ion in the chromic acid is converted (i.e., reduced) from a negative valence (i.e., $-6$) to a positive valence (i.e., $+3$). As a result of this change the individual components of the preservative precipitate and become fixed within the wood. Arsenates and basic salts are formed which solubilize with difficulty.

The preservative solution must necessarily be initially acidic in nature in order to dissolve the preservative. The use of a pH as low as 2 is common. However, the higher the acidity the faster is the fixation of the preservative in the wood. The use of ordinary pressure treatments under these circumstances is generally not disadvantageous since the penetration takes place so fast that the preservative is distributed within the wood before the fixation occurs. A slower introduction of the solution results in considerable fixation during the penetration and causes poor distribution of the preservative in the wood. As soon as the preservative becomes fixed it will not be further distributed within the wood, and cannot therefore penetrate the cell walls in foliiferous wood.

The first preservative can be modified so that it will accordingly not be prematurely fixed and can be used in the process of the present invention. The preservative is modified by rendering it more alkaline by adding ammonia in a suitable manner and in suitable amounts. A small amount of ammonia causes precipitation but further ammonia additions ensure dissolution. By making the preservative solution more alkaline in nature the reduction of the chromic acid is delayed or avoided after the introduction of the solution into the wood until the solution is evaporated from the wood. The reduction begins to occur during drying when the ammonia evaporates and the solution becomes less alkaline and more concentrated within the wood. At that time a slow fixation of the preservative takes place.

As copper has a strong affinity for wood it is desirable to use an excess of ammonia therewith to avoid an early fixation of the copper. Furthermore, carbon dioxide can preferably be added (e.g., in the form of ammonium bicarbonate) in order to delay the evaporation of the ammonia and to increase the stability of the solution.

A typical preservative solution containing copper, chromium and arsenic (as disclosed within U.S. Pat. No. 2,565,175) may contain preservative components in the following exemplary amounts:

| In solid form | | In aqueous solution | |
|---|---|---|---|
| CuO | 19.6 percent by weight | CuO | 0.27 percent by weight |
| $CrO_3$ | 35.3 | $CrO_3$ | 0.48 |
| $As_2O_5$ | 45.1 | $As_2O_5$ | 0.61 |

In order to neutralize the chromic and arsenic acids in said solution and to dissolve the copper-oxide an ammonia content of at least about 0.7 percent by weight is generally required. Generally the ammonia content of the solution will range from about 0.7 percent to about 5 percent by weight. The amount of ammonia may exceed about 5 percent by weight but such would not increase the effectiveness of the preservative treatment as the solution would already be rendered sufficiently alkaline to achieve the aims of the invention by using amounts of ammonia within the stated range. Enough ammonia need only be added to neutralize the arsenic and chromic acids as well as providing an excess thereof. The pH of the solution is advantageously increased to at least about 8.2 in order to provide the desired alkalinity, and preferably ranges from about 8.2 to about 10. Advantageously, such solutions will contain from about 0.16 to about 0.80 percent by weight of copper.

Thus the aqueous preservative solution may have the following exemplary composition if adapted for use in the present invention:

CuO 0.2 to about 0.8 percent by weight
$CrO_3$ 0.2 to about 0.5
$As_2O_5$ 0.4 to about 0.7
$NH_3$ 0.6 to about 2.4
$CO_2$ 0.8 to about 2.4

A preferred composition for the preservative solution is as follows:

CuO 0.27 percent by weight
$CrO_3$ 0.48
$As_2O_5$ 0.61
$NH_3$ 0.91
$CO_2$ 1.40

The preservative solution of U.S. Pat. No. 2,149,284 is based on a copper compound and arsenic trioxide dissolved by means of ammonia. After the wood preservation treatment the ammonia is allowed to evaporate and the soluble preserving ingredients are precipitated (i.e., fixed within the wood. The fixation proceeds quickly but slower than the fixation of a preservative containing copper oxide, chromic acid, and arsenic acid. In order to provide a preservative suitable for use in the present invention such that the fixation can be controlled to ensure penetration of the cell walls, the amount of solvent (i.e., the ammonia) must be increased.

The solution should preferably also be stabilized with carbon dioxide since ammonia has a tendency to evaporate very readily from the solution. Such addition may be employed in many types of alkaline preservative solutions. This may be simply carried out by increasing the content of ammonia by about 20 percent by weight based on the original ammonia content with the addition of a major portion of it in the form of ammonium bicarbonate. It is further advantageous to replace the arsenic trioxide in the preservative by arsenic acid to provide a more stable solution.

In the ammoniacal preservative solutions possibilities exist whereby the amount of the active ingredients may be varied to obtain the desired effect. This is more difficult in the acidic preservatives which contain chromic acid. These preservatives must, in order to be dissolvable, have a high content of chromic acid (and arsenic acid) even if these amounts are not needed for the fixation or to provide the preservative effect.

In the ammoniacal preservatives the chromic and arsenic acids provide no dissolving function. Therefore the arsenic acid is introduced only in an amount required to produce the desired effect. The arsenic acid is fixed by the copper compound. If the arsenic acid is present in a high amount or a higher fixation of it is desired chromic acid may be introduced only in the amount needed to provide for the fixation of the arsenic acid.

Such a preservative adapted for the present invention may contain preservative components in the following exemplary amounts:

In aqueous solution

CuO 0.2 to about 1.0 percent by weight
$CrO_3$ 0.1 to about 0.3
$As_2O_5$ 0.1 to about 0.3
$NH_3$ 0.6 to about 2.8
$CO_2$ 0.8 to about 2.8

A preferred preservative is as follows:

| In solid form | | In aqueous solution | |
|---|---|---|---|
| CuO | 6.5 percent by weight | CuO | 0.30 percent by weight |
| $CrO_3$ | 3.5 | $CrO_3$ | 0.16 |
| $As_2O_5$ | 3.5 | $As_2O_5$ | 0.16 |
| $NH_3$ | 20.7 | $NH_3$ | 0.95 |
| $CO_2$ | 39.0 | $CO_2$ | 1.80 |
| Water | 26.8 | | |

As this preservative is of special interest it should be noted that the preservative may be used in different concentrations in the different treating methods. The exemplary solutions may thus be used for full cell pressure treatment or open-tank treatment. If the preservative is introduced by the Lowry method when about half the amount of solution is introduced per unit of wood as compared to a full cell treatment, it is desirable to use a double strength solution in order to provide the desired amount of preservative in the wood. Such a doubled strength may also be used when treating incompletely dried wood by a full cell method. For soaking diffusion treatment of green wood the concentration of the solution may, for instance, be two to four times higher than the exemplified solutions.

If zinc compounds are included in the preservative solution instead of copper compounds the ammonia and carbon dioxide amounts should be increased around 50 percent. The zinc preservatives are somewhat more difficult to dissolve and they are also less effective. On the other hand, they do not color the wood nearly as much such that this method is generally preferred.

The preservative solution containing zinc compounds and arsenic trioxide dissolved in acetic acid may also be introduced into the wood by a pressure treatment. If differs from the two other preservative solutions in that it is not so quickly fixed since the acetic acid evaporates rather slowly from the wood. This property would be an advantage in the present invention except that the acetic acid evaporates incompletely. The result is a poor fixation and the preservative exhibits a lowered effect due to leaching.

In order to improve the fixation of preservatives of this type special steps may be taken. In U.S. Pat. No. 2,749,256, a heating of the wood is recommended during which the rate of fixation is increased. It is also disclosed, however, that the wood is treated with a copper formate solution.

In order for this preservative to be most suitable for use in the present invention the amount of acetic and/or formic acid should be increased 10 to 25 percent. Furthermore, steps have to be taken to improve the fixation after the preservative has penetrated the cell wall.

For example, an exemplary aqueous preservative solution may contain from about 2 to about 6 percent by weight of a preservative which comprises about 20 percent by weight of copper acetate, about 70 percent by weight of zinc acetate, and about 10 percent by weight of acetic acid.

Besides such aqueous preserving solutions, preservatives dissolved in organic solvents can be used. Such solutions are not preferred, however, since they are also rather expensive.

The wood may be treated with a preservative solution as follows. The wood may be initially pressure treated according to the full cell method. Treatment of the wood using a method according to Lowry or Ruping may also be used.

After the pressure treatment the wood is stored for some time under conditions such that it cannot dry and such that the preservation composition solvents cannot evaporate. This can be done, for example, in a closed space. The wood can also be covered. Of course, the wood can also be stored or kept in contact with a preservative solution, but as a rule such arrangements are not very practical. The storing time may last as long as two to four weeks but can be even longer. The preservative is allowed to remain in an undried (i.e., unfixed) state long enough such that it can diffuse through the cell walls. The diffusion process occurs slowly but with great effectiveness.

While the actual period during which the treated wood must be kept in an undried condition will vary with the preservative employed and the type of wood being treated, it can be stated that the wood should be kept in an undried condition for a sufficient period of time to provide the necessary retention of the preservative (e.g., copper) in the individual wood fibers (i.e., sufficient diffusion through the cell wall has occurred). An energy dispersible X-ray spectometer may be used to determine the preservative content of the wood fiber.

After it has been determined that the preservative has diffused through the cell walls of the wood, the wood is dried whereby the solvents (e.g., ammonia) evaporate and the preservatives are precipitated and become fixed within the wood.

In addition to this treatment it is advantageous to warm the wood. The wood can be warmed either before, during or after the introduction of the preservative solution.

A warming period prior to the introduction of the preservative will facilitate the penetration of the preservative into the wood. It is most conveniently done with steam or water at, for example, 80° to 110° C. The enhancement of the wood treatment is a function of the temperature of the wood and also of the dimensions of the wood since a longer time is required for warming wood of increased dimensions. The wood may be warmed in any conventional manner. For example, boards with a thickness of about 25 mm can be steamed or warmed in water for one or two hours, while poles should be treated for at least two to four hours. Longer warming periods are rarely employed.

The warming of the wood may also be carried out during the diffusion period after the preservative treatment. As a general rule the same high temperature cannot be employed. The temperature has to be limited to a maximum of about 40° to 50° C. in cases wherein ammonia and carbon dioxide (e.g., in the form of ammonium bicarbonate) are used as dissolving agents in view of their tendency to readily evaporate at high temperatures. If, for example, acetic acid is used as a dissolving agent, high temperatures may be employed. Lower temperature warming can be used for an extended time, for example, during the entire diffusion period, with the warming increasing the rate of the diffusion.

The wood may also be warmed at the end of the diffusion period in order to increase the drying rate of the wood and the fixation rate of the preservatives.

The preservatives may be introduced into the wood by several methods. If the wood is incompletely dried, a pressure preservation treatment with a strong solution, for example, a double strength solution, may be applied. Such a pressure treatment does, of course, not provide for full penetration of the wood. During the following diffusion period, however, the wood treatment is improved because the preservative penetrates and is distributed by diffusion into the wood. It also slowly penetrates the cell walls. Even undried (green) wood can thus be preserved. This is accomplished by soaking the wood in a strong solution from which the preservative diffuses into the wood. The soaking is then followed by a diffusion period as earlier described.

Diffusion by means of soaking in strong solutions is a known treatment. Soluble salts have been used in this treatment and the salts have remained soluble (i.e., unfixed) even after the treatment. The salts may have a high preserving effect but they have not been able to completely protect the wood since they are later leached out from the wood. The use of chromic acid solutions, for example, generally provide very poor penetration and distribution of the preservative in the wood due to early fixation. One criteria, among others, which aids in the successful preservation of wood is thus the use of solutions according to the present invention which will more effectively diffuse throughout the wood.

A preservation method of special interest is opentank preservation. This treatment is carried out by first warming wood by suitable means such as by steam, water or a hot preservation solution, and then soaking the wood in the preservative solution. During the soaking step the wood absorbs the solution and is penetrated by the preservative. The desirable warming of the wood may thus be included as a part of the preservation step itself. If the preservation solutions of this invention are used and if the wood thereafter is stored in an undried state as described, foliiferous wood can be successfully preserved. The method is simple both in view of apparatus and performance, which is a great advantage in less industrially developed countries where foliiferous wood often exists. In such areas the simple but time consuming method of soaking in solutions according to this invention may be acceptable.

It should be noted that there is a difference between diffusion that provides introduction and distribution of the preservative in the wood and diffusion that gives penetration through the cell wall.

The diffusion that provides for introduction and distribution of the preservative in the wood occurs by the time consuming diffusion methods of soaking in strong solutions. The penetration of the wood occurs in one direction from the surface to the inner parts of the wood. For thicker wood a longer diffusion time is needed because the preservative must diffuse through a larger mass of wood.

Diffusion through the cell walls is distinct from diffusion into the wood. In this case the preservative surrounds the wood fiber and the preservative must pass through the cell wall of the wood fibers from all sides and different directions. It is a very short and comparatively constant length of travel for the preservative and is independent of the direction of penetration and the dimension of the wood.

The increased effectiveness of the preservation treatment of the present invention is believed to be due to the fact that a correlation has been found to exist between the preservative content of the wood (e.g., copper) and the loss in dry mass of the wood when ammoniacal preservatives are employed together with maintaining the treated wood in an undried state for a period of time sufficient for the preservative to diffuse through the cell walls (i.e., delayed drying). No such correlation has been found to exist with such preservative solutions when conventional drying procedures are employed. In fact, the loss in dry mass has been found to be significantly higher for wood preservatives with conventional (i.e., normal) drying as opposed to delayed drying. Accordingly, the wood must be kept in an undried condition for a sufficient period of time to provide the required penetration of the wood fibers by the preservative.

Table 1 below sets forth the results of field tests which confirm the previous statements. Several types of preservative solutions were used in the field tests for the sake of comparison. The wood samples used were initially treated with the preservative solutions and subjected to either delayed drying (DD) or normal drying (ND) conditions. The cubes were then exposed to the elements for a period of 18 months, with the average loss in dry mass of the cubes being measured after 12 and 18 months.

The following preservative solutions and procedures were used to determine the effectiveness of the preservative treatment of the present invention:

(A) KP-N special N.: 800 grams of a commercial ammoniacal preservative (tradename Cuprinel Tryck) having a copper content of 9.7 percent is used as the base solution and is described in U.S. Pat. No. 4,001,400, herein incorporated by reference. The solution is admixed with an additional 400 grams of dissolving ammonium bicarbonate to increase the stability of the preservative and render it more alkaline. The solution is admixed with 25 liters of water to provide a solution containing 3.2 percent of preservative.

(B) KP-N special 2 N.: The ingredients employed above to produce KP-N special N are doubled and dissolved in 25 liters of water to provide a preservative concentration of 6.4 percent.

(C) Amline special: Amline is a tradename of a preservative containing 6 percent Cu, 4 percent $As_2O_5$, and 4 percent $CrO_3$. Ammonium bicarbonate is used as a dissolving agent to provide stability. A solution is made up which contains 4.25 percent of the preservative.

(D) KP-N: 800 grams of the preservative Cuprinel Tryck were dissolved in 25 liters of water to provide a concentration of 3.2 percent.

(E) CCA: The preservative contains $As_2O_5$, $CrO_3$ and Cu corresponding to 11.8 percent Cu, 13.8 percent chromium, and 22.2 percent arsenic and was used in a concentration of 1.8 percent.

The wood samples were impregnated in various ways using the above solutions. Those samples which were treated with one of solutions A, B or D were contacted with the preservative at a vacuum of −0.75 bars for 45 minutes followed by a pressure treatment at 11 bars for 1 hour. Those samples treated with solutions C and E were contacted with the preservative at a vacuum of −0.95 bars for 30 minutes and a pressure of 10 bars for 1 hour.

Wood samples treated with solutions A, B and C were separately tightly wrapped in plastic and stored for three weeks outdoors under cover (i.e., delayed drying (DD) conditions) at an average temperature of 15° C. Samples treated with solutions D and E were allowed to dry outdoors under cover (i.e., normal drying (ND) conditions).

At the end of three weeks the wrapped wood samples were exposed to air and allowed to dry in the same manner as the non-wrapped wood. After a 1½ month drying period the samples were placed in contact with the ground to determine their resistance to rot. Samples were buried in soil at about a depth of 30 millimeters in a greenhouse at a temperature ranging from 10° to 20° C. depending upon the season. Samples of the buried wood were extracted from the soil after exposure periods of 12 and 18 months to determine their loss in dry mass.

The degradation of the wood was examined using light microscopy and scanning electron microscopy (Cambridge S 150). Thin transverse and longitudinal sections of the wood were stained with safranin and viewed under the light microscope. Polarized light was used for the longitudinal sections. The results of the tests are set forth below in Table 1.

TABLE 1

Retention of Preservative Elements and Loss in Dry Mass of Test Wood Samples

| | Retention (mg/g) | | | Loss in Dry Mass | |
|---|---|---|---|---|---|
| Treatment | Cu | Cr | As | 12 months | 18 months |
| 4.25% Amline sp DD | | | | | |
| Beech | 3.14 | 1.01 | 1.40 | 5.0 | 5.5 |
| Birch | 3.40 | 1.07 | 1.44 | 4.4 | 5.0 |
| 3.2% KP-N sp DD | | | | | |
| Beech | 2.09 | — | — | 3.6 | 9.0 |
| Birch | 2.51 | — | — | 2.3 | 7.1 |
| 6.4% KP-N sp DD | | | | | |

TABLE 1-continued

Retention of Preservative Elements and Loss in Dry Mass of Test Wood Samples

| Treatment | Retention (mg/g) | | | Loss in Dry Mass | |
|---|---|---|---|---|---|
| | Cu | Cr | As | 12 months | 18 months |
| Beech | 5.05 | — | — | 1.5 | 1.6 |
| Birch | 3.87 | — | — | 2.7 | 4.3 |
| 3.2% KP-N ND | | | | | |
| Beech | 2.69 | — | — | 11.0 | 10.1 |
| Birch | 2.61 | — | — | 7.6 | 15.3 |
| 1.8% CCA ND | | | | | |
| Beech | 1.83 | 1.91 | 2.54 | 7.7 | 15.8 |
| Birch | 2.71 | 2.78 | 4.86 | 8.4 | 20.9 |
| Untreated Control | | | | | |
| Beech — | — | — | — | 46.9 | 60.7 |
| Birch — | — | — | — | 37.1 | 47.3 |

Soft rot was the only type of attack observed in the wood. Both cavity formation (Type 1) and erosion of the cell walls (Type 2) was observed.

In the wood treated with solution C with delayed drying, soft rot attack in the beech wood was confined mainly to the outermost parts of the blocks. Type 1 and 2 attack occurred in patches between areas of non-decayed fibers. The birch wood treated with solution C exhibited only a minor attack of Type 2 after 12 months and no cavities were found. After 18 months both types of attack were observed in the outermost parts of the block.

The main type of attack observed in the wood treated with solution A with delayed drying after 12 months was Type 1. Strong patches of erosion were observed after 18 months. Both Type 1 and 2 attack was found in the birch wood.

Only a minor amount of attack was observed in the beech and birch wood treated with solution B with delayed drying. Both Type 1 and 2 attack occurred in the outermost parts of the beech wood. Large areas were not attacked at all. Only Type 2 was observed in the birch wood after 12 months and the attack was restricted to the outermost portions of the wood. No attack was observed in the birch wood after 18 months.

Solution D treated birch and beech wood exhibited strong soft rot attack of both types.

The wood treated with solution E exhibited homogeneous soft rot attack. Type 1 appeared to be the dominate type of attack in the beech wood, while the birch wood was degraded by both types of soft rot.

While the invention has been described in connection with a preferred embodiment thereof, it is to be understood that the present disclosure is illustrative rather than restrictive and further modification may be resorted to without departing from the spirit of the invention or the scope of the claims.

I claim:

1. In a method of preserving foliiferous wood wherein the wood is penetrated by a preservative solution, the improvement comprising:

penetrating the wood with a solution having a wood preservative dissolved therein;

maintaining the wood in an undried condition for a period of time of at least two weeks sufficient for the preservative solution to diffuse through the cell walls of the wood without fixation thereof; and thereafter drying the wood so as to fix the preservative within the wood.

2. The method of claim 1 wherein the wood is maintained in an undried condition for a period of time of between two to four weeks.

3. The method of claim 1 wherein the wood is warmed before introducing the solution of preservative to a temperature of from about 80° to 110° C.

4. The method of claim 1 wherein the wood is warmed as it is maintained in an undried condition so as to aid the penetration and diffusion steps.

5. The method of claim 1 wherein the preservative solution has about the following composition:

CuO 0.2 to about 1.0 percent by weight
$CrO_3$ 0.1 to about 0.3
$As_2O_5$ 0.1 to about 0.3
$NH_3$ 0.6 to about 2.8
$CO_2$ 0.8 to about 2.8

6. The method of claim 1 wherein the solid preservative has about the following composition:

CuO 6.5 percent by weight
$CrO_3$ 3.5
$As_2O_5$ 3.5
$NH_3$ 20.7
$CO_2$ 39.0
$H_2O$ 26.8

7. The method of claim 1 wherein the preservative solution contains arsenic trioxide, arsenic acid, boric acid, and/or hydrofluoric acid.

8. The method of claim 1 wherein the preservative solution contains a copper and/or zinc compound dissolved in an excess of ammonia and or ammonium bicarbonate such that the preservative is not fixed until the wood is dried.

9. The method of claim 8 wherein the pH of the preservative solution is at least about 8.2.

10. The method of claim 1 wherein the preservative solution contains a copper and/or zinc compound dissolved in an excess of acetic and/or formic acid such that the preservative is able to diffuse through the cell walls and is not fixed until the wood is dried.

11. The method of claim 1 wherein the wood is treated according to a method selected from the group consisting of the full cell, Lowry or Ruping methods.

12. The method of claim 1 wherein the wood is treated by the open-tank method.

13. In a method of preserving foliiferous wood by treatment of the wood with a copper-containing ammoniacal preservative, the improvement comprising providing an excess of ammonia in said preservative such that the pH thereof exceeds about 8.2 and maintaining the wood treated with said preservative in an undried state for a period of time of at least two weeks sufficient to permit the preservative to diffuse through the cell walls of the wood, and then allowing the wood to dry such that the preservative then becomes fixed in the wood.

14. The method of claim 13 wherein the preservative solution includes ammonium bicarbonate.

15. The method of claim 13 wherein the preservative solution contains from about 0.16 to about 0.8 percent by weight of copper.

16. The method of claim 13 wherein the preservative contains at least about 0.6 percent by weight of ammonia.

17. The method of claim 10 wherein said preservative solution is an aqueous solution which contains from about 2 to about 6 percent by weight of a preservative having about the following composition:

copper acetate 20 percent by weight
zinc acetate 70
acetic acid 10

18. The method of claim 13 wherein the wood is maintained in an undried state for a period of time of between two to four weeks.

* * * * *